US009895792B2

(12) United States Patent
Chen

(10) Patent No.: US 9,895,792 B2
(45) Date of Patent: Feb. 20, 2018

(54) WORKPIECE CLAMP DEVICE CAPABLE FOR CHANGING CLAMP ANGLE

(71) Applicant: Ju-Tan Chen, Taichung (TW)

(72) Inventor: Ju-Tan Chen, Taichung (TW)

( * ) Notice: Subject to any disclaimer, the term of this patent is extended or adjusted under 35 U.S.C. 154(b) by 0 days.

(21) Appl. No.: 15/188,466

(22) Filed: Jun. 21, 2016

(65) Prior Publication Data

US 2017/0361426 A1 Dec. 21, 2017

(51) Int. Cl.

| | |
|---|---|
| ***B25B 5/08*** | (2006.01) |
| ***B25B 1/08*** | (2006.01) |
| ***B25B 1/24*** | (2006.01) |
| ***B25B 5/10*** | (2006.01) |
| ***B25B 1/10*** | (2006.01) |
| *B25B 5/16* | (2006.01) |

(52) U.S. Cl.

CPC ..... *B25B 1/08* (2013.01); *B25B 1/10* (2013.01); *B25B 1/241* (2013.01); *B25B 1/2405* (2013.01); *B25B 5/08* (2013.01); *B25B 5/10* (2013.01); *B25B 5/163* (2013.01)

(58) Field of Classification Search

CPC .... B25B 5/08; B25B 1/08; B25B 5/10; B25B 5/163; B25B 1/2426; B25B 1/2452; B25B 1/2405; B25B 1/10

USPC ..... 269/234, 153, 232, 257, 258, 138

See application file for complete search history.

(56) References Cited

U.S. PATENT DOCUMENTS

| | | | | | |
|---|---|---|---|---|---|
| 2,625,861 | A * | 1/1953 | Swanson | B23Q 3/06 | 24/523 |
| 3,406,958 | A * | 10/1968 | Geneloni | B25B 5/08 | 269/137 |
| 3,596,898 | A * | 8/1971 | Hilburn | B23K 37/0533 | 269/243 |
| 4,139,188 | A * | 2/1979 | Avedian | B25B 1/08 | 269/196 |
| 4,223,879 | A * | 9/1980 | Wolfe | B23Q 3/066 | 269/136 |
| 4,489,927 | A * | 12/1984 | Yamada | B23Q 3/102 | 269/137 |

(Continued)

FOREIGN PATENT DOCUMENTS

| | | | |
|---|---|---|---|
| AT | 506147 A1 | * | 6/2009 |
| DE | 705856 C | * | 4/1941 |

(Continued)

*Primary Examiner* — Larry E Waggle, Jr.
*Assistant Examiner* — Mahdi H Nejad
(74) *Attorney, Agent, or Firm* — Jackson IPG PLLC; Demian K. Jackson

(57) ABSTRACT

A workpiece clamp device capable for changing clamp angle is arranged on a base plane and comprises a first and a second movable blocks, a driving block, at least one first and at least one second elastic members, at least one first and at least one second cylinders, and at least one third and at least one fourth elastic members. Since the first and the second cylinders are slightly rotatably and detachably respectively embedded in the first and the second embedding grooves to make the first and the second rough surfaces be exposed and the elasticity of the third and the fourth elastic members is cooperated therewith, the first and the second rough surfaces are slightly fine-tuned based on the shapes and sizes of the workpieces so as to be suitable for clamping and fastening the workpieces with different shapes.

8 Claims, 11 Drawing Sheets

(56) References Cited

U.S. PATENT DOCUMENTS 4,643,411 A * 2/1987 Izumi ..... B25B 1/08 269/138
4,736,935 A * 4/1988 Vasapolli ..... B25B 1/08 269/137
4,969,638 A * 11/1990 Yang ..... B25B 1/2426 269/258
H906 H * 4/1991 Baggett ..... 254/104
5,056,766 A * 10/1991 Engibarov ..... B25B 1/08 269/101
5,135,209 A * 8/1992 Penny ..... B25B 5/101 269/249
5,188,347 A * 2/1993 Hunnell ..... B25B 1/103 269/258
5,641,257 A * 6/1997 Bernstein ..... B25B 5/08 269/232
5,735,513 A * 4/1998 Toffolon ..... B25B 1/08 269/138
5,799,933 A * 9/1998 Yang ..... B25B 1/2426 269/258
6,126,158 A * 10/2000 Engibarov ..... B25B 5/08 269/101
6,431,534 B1 * 8/2002 Orosz ..... B25B 5/101 269/249
7,172,183 B1 * 2/2007 Yang ..... B25B 5/068 269/3
8,002,254 B2 * 8/2011 Bayer ..... B23Q 1/0018 269/20
8,253,520 B2 * 8/2012 Yang ..... B25B 11/005 269/266
8,641,989 B2 * 2/2014 Marsing ..... G01N 1/312 269/309
8,646,738 B2 * 2/2014 Stoob ..... B64D 11/04 248/188.4
8,650,961 B2 * 2/2014 Hanoomanjee ..... B25B 5/08 73/11.04
8,925,258 B1 * 1/2015 Header ..... E05D 15/00 16/90
9,393,656 B1 * 7/2016 Weber ..... B23Q 3/103
9,448,537 B2 * 9/2016 Lindsay ..... G04D 1/025
2002/0109282 A1 * 8/2002 Peck ..... B25B 1/2442 269/258
2003/0197319 A1 * 10/2003 Ho ..... B25B 1/08 269/246
2005/0280196 A1 * 12/2005 Ray Avalani ..... B25B 5/068 269/6
2010/0264269 A1 * 10/2010 Stoob ..... B64D 11/04 244/118.5
2011/0278781 A1 * 11/2011 Yang ..... B25B 1/2426 269/266
2016/0144472 A1 * 5/2016 Merilainen ..... B25B 1/02 29/559

FOREIGN PATENT DOCUMENTS

DE 202016103652 U1 * 7/2016
DE 202016103988 U1 * 10/2016
EP 104286 A1 * 9/1982
EP 1125690 A2 * 2/2001
EP 2070655 A2 * 12/2008
FR 2601610 A1 * 7/1986

* cited by examiner

WORKPIECE CLAMP DEVICE CAPABLE FOR CHANGING CLAMP ANGLE

FIELD OF THE INVENTION

The present invention relates to a tool clamp apparatus, and more particularly to a workpiece clamp device capable for changing clamp angle.

BACKGROUND OF THE INVENTION

In the market, one end of the common vise mainly is connected to a movable jaw. A movable jaw is slidably arranged at a top surface of the vise and driven by a screw rod to move. A workpiece is clamped and fastened by the fixing jaw and the movable jaw so as to process smoothly. But this kind of vise may only clamp single one workpiece once. It needs more processing time to process single one workpiece once. And because the vise needs to be released every time and the workpiece needs to be changed ever time, it makes the process more difficult and inconvenient.

Please reference to Taiwanese patent no. 339003, it disclosed a two-way positioning clamp system. The clamp system mainly comprises two stop blocks. A tapered surface is arranged at the opposite sides of the two stop blocks. A tapered push block is arranged between the two tapered surfaces of the two stop blocks. A bolt is passing through the push block. A hook block is arranged at each side of the stop block for hooking a spring. The side of the stop block hooked the spring has a side plate. A limit bar is arranged at each side plate for abutting against the spring. When the bolt is screwed in a screw hole of a machine, a head portion of the bolt may push the push block to move and the push block may push the two stop blocks to move outward so as to clamp and fasten the workpiece and improve the elasticity of the whole clamp system.

However, the tapered surfaces are smooth so that the workpiece may be slid or rotated to become defect while the workpiece is clamped and processed. Besides, the tapered surfaces are fixed to be suitable for the workpiece with only one size (that is, single one depth and width). The scope of applicability is too narrow.

Accordingly, the inventor of the present invention has devoted himself based on his many years of practical experiences to solve this problem.

SUMMARY OF THE INVENTION

In order to solve above mentioned problems, an object of the present invention is to provide a workpiece clamp device capable for changing clamp angle. When operating, lots of the workpiece clamp devices of the present invention is arranged on the base plane and spaced apart from one another. Each workpiece may be arranged between two adjacent workpiece clamp devices. When the bolt is screwed in the base plane, the first movable block and the second movable block of each workpiece clamp device are moved outward (move to the direction opposite to the driving block) to clamp the workpiece therebetween to achieve the effect of clamping. That is, the first movable block of one of the two adjacent workpiece clamp devices and the second movable block of the other one thereof are arranged corresponding to each other and moved to each other.

In order to achieve the above object, a workpiece clamp device capable for changing clamp angle, arranged on a base plane, the device comprising a first movable block, having a first main body, a first inclined surface, a first limit portion, and a first clamp surface, the first inclined surface is arranged at an inner side of the first main body, the first inclined surface is inclined from bottom to top and from interior to exterior, the first clamp surface is arranged at an outer side of the first main body and corresponding to the first inclined surface, the first limit portion is arranged at each of a front end and a rear end of the first main body, the first inclined surface has at least one first stop portion, at least one first embedding groove is arranged at the first clamp surface, a first receiving groove is further concavely arranged inside the at least one first embedding groove, an axial direction of the at least one first embedding groove is orthogonal to an axial direction of the first receiving groove; a second movable block, arranged corresponding to the first movable block and having a second main body, a second inclined surface, a second limit portion, and a second clamp surface, the second inclined surface is arranged at an inner side of the second main body, the second inclined surface is inclined from bottom to top and from interior to exterior, the second clamp surface is arranged at an outer side of the second main body and corresponding to the second inclined surface, the second limit portion is arranged at each of a front end and a rear end of the second inclined surface, the second inclined surface has at least one second stop portion, at least one second embedding groove is arranged at the second clamp surface, a second receiving groove is further concavely arranged inside the at least one second embedding groove, an axial direction of the at least one second embedding groove is orthogonal to an axial direction of the second receiving groove, the first inclined surface is faced to the second inclined surface and an inverted cone receiving space is defined between the first inclined surface and the second inclined surface; a driving block, arranged between the first movable block and the second movable block and arranged in the receiving space so as to move up and down, the driving block has a third main body, a third inclined surface, a fourth inclined surface, at least one third stop portion, at least one fourth stop portion, a third limit portion, and a fourth limit portion, the third inclined surface and the fourth inclined surface are respectively arranged at two sides of the third main body, the third inclined surface is faced to the first inclined surface and inclined from bottom to top and from interior to exterior, the fourth inclined surface is faced to the second inclined surface and inclined from bottom to top and from interior to exterior, the at least one third stop portion is arranged on the third inclined surface and corresponding to the at least one first stop portion, the at least one fourth stop portion is arranged on the fourth inclined surface and corresponding to the at least one second stop portion, the third limit portion is arranged at each of a front edge and a rear edge of the third inclined surface and corresponding to the first limit portion to cooperate with each other so as to slidably limit, the fourth limit portion is arranged at each of a front edge and a rear edge of the fourth inclined surface and corresponding to the second limit portion to cooperate with each other so as to slidably limit; at least one first elastic member, arranged between the at least one first stop portion and the at least one third stop portion, two ends of the at least one first elastic member are respectively abutted against the at least one first stop portion and the at least one third stop portion; at least one second elastic member, arranged between the at least one second stop portion and the at least one fourth stop portion, two ends of the at least one second elastic member are respectively abutted against the at least one second stop portion and the at least one fourth stop portion; at least one first cylinder, slightly rotatably and detachably arranged in the at least one first embedding groove, the at least one first cylinder has a first cylindrical body and a first rough surface, the first rough surface is arranged at one side of the first cylindrical body along a length direction thereof, the first cylindrical body is received in the at least one first embedding groove, and the first rough surface is exposed outside of the at least one first embedding groove; at least one second cylinder, slightly rotatably and detachably arranged in the at least one second embedding groove, the at least one second cylinder has a second cylindrical body and a second rough surface, the second rough surface is arranged at one side of the second cylindrical body along a length direction thereof, the second cylindrical body is received in the at least one second embedding groove, and the second rough surface is exposed outside of the at least one second embedding groove; at least one third elastic member, received in the at least one first receiving groove, two ends of the at least one third elastic member are respectively abutted against the at least one first receiving groove and one side of the at least one first cylinder opposite to the first rough surface; and at least one fourth elastic member, received in the at least one second receiving groove, two ends of the at least one fourth elastic member are respectively abutted against the at least one second receiving groove and one side of the at least one second cylinder opposite to the second rough surface.

In some embodiments, the at least one first stop portion, the at least one second stop portion, the at least one third stop portion, and the at least one fourth stop portion are a vertical blind hole for each.

In some embodiments, the first limit portion and the second limit portion are a sliding groove for each, the third limit portion and the fourth limit portion are a sliding track for each, the first limit portion and the third limit portion are cooperated with each other so as to slidably limit, and the second limit portion and the fourth limit portion are cooperated with each other so as to slidably limit.

In some embodiments, the first rough surface and the second rough surface are arranged a plurality of square pyramids.

In some embodiments, the third main body of the driving block has a vertical step hole, a bolt is passing through the vertical step hole of the driving block so as to screw with the base plane, a head portion of the bolt is abutted against the vertical step hole, the driving block is controlled to move up and down because the bolt is screwed in and screwed out relative to the base plane and simultaneously cooperated with the elasticity of the at least one first elastic member and the at least one second elastic member, and the third inclined surface is pushed the first inclined surface and the fourth inclined surface is pushed the second inclined surface so that the first movable block and the second movable block are moved inward and outward.

In some embodiments, the at least one first embedding groove is a single one first embedding groove, the at least one second embedding groove is a single one second embedding groove, the axial direction of the first embedding groove is parallel to a length direction of the first movable block, and the axial direction of the second embedding groove is parallel to a length direction of the second movable block.

In some embodiments, the at least one first embedding groove is two first embedding grooves which are spaced apart from each other, the at least one second embedding groove is two second embedding grooves which are spaced apart from each other, the axial direction of each first embedding groove is parallel to a height direction of the first movable block, and the axial direction of each second embedding groove is parallel to a height direction of the second movable block.

In some embodiments, a longitudinal section of each of the first clamp surface and the second clamp surface is concave V-shaped, the first clamp surface has a first upper half portion and a first lower half portion, the second clamp surface has a second upper portion and a second lower portion, the at least one first embedding groove is two first embedding grooves which are respectively concavely arranged at the first upper half portion and the first lower half portion, the at least one second embedding groove is two second embedding grooves which are respectively concavely arranged at the second upper half portion and the lower half portion, the axial direction of each first embedding groove is parallel to a length direction of the first movable block, and the axial direction of each second embedding groove is parallel to a length direction of the second movable block.

Further features and advantages of the present invention will become apparent to those of skill in the art in view of the detailed description of preferred embodiments which follows, when considered together with the attached drawings and claims.

BRIEF DESCRIPTION OF THE DRAWINGS

All the objects, advantages, and novel features of the invention will become more apparent from the following detailed descriptions when taken in conjunction with the accompanying drawings.

DESCRIPTION OF THE PREFERRED EMBODIMENT

Figure 1:
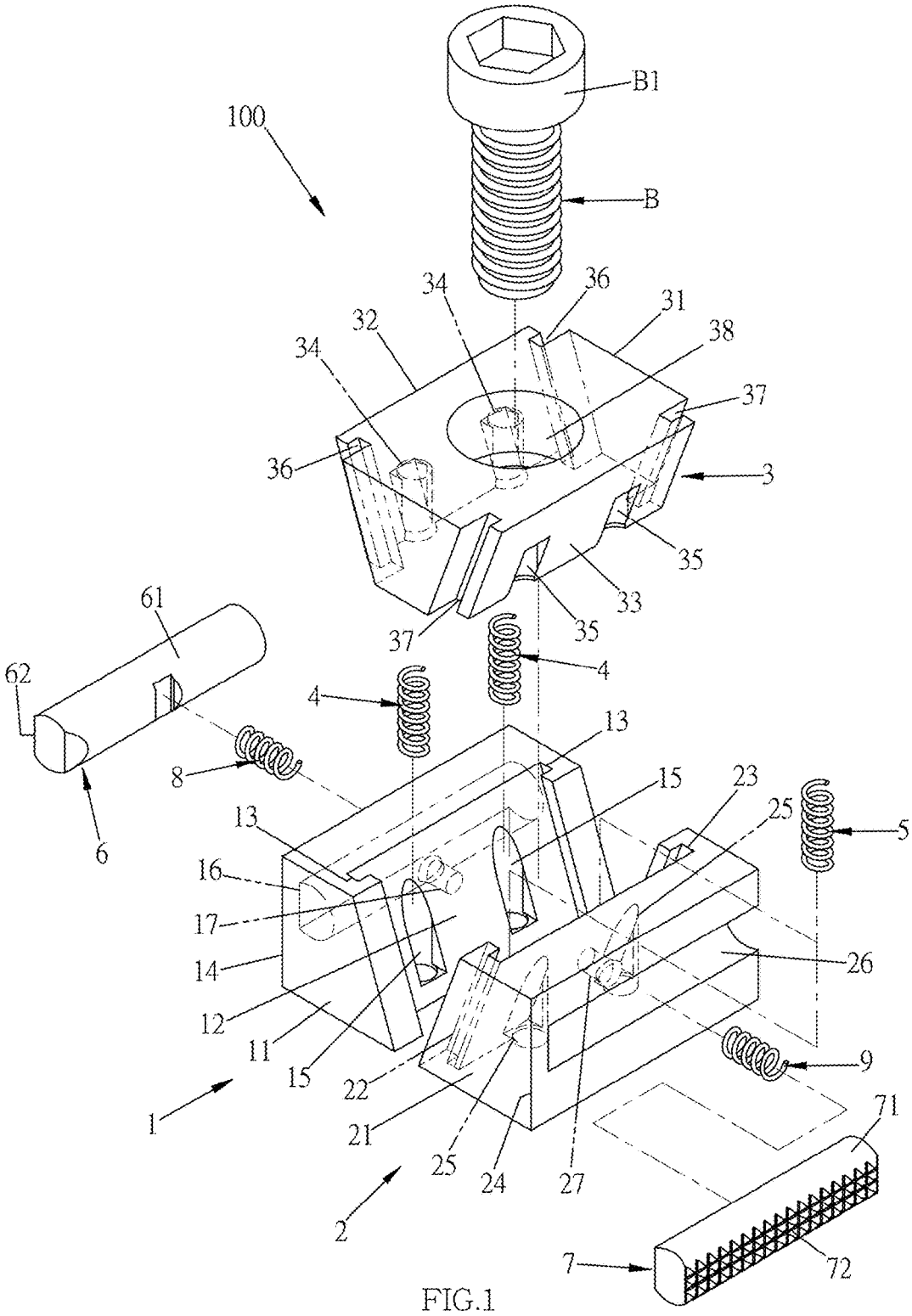
FIG. 1 is an exploded view of a first embodiment of a workpiece clamp device capable for changing clamp angle of the present invention.
Figure 2:
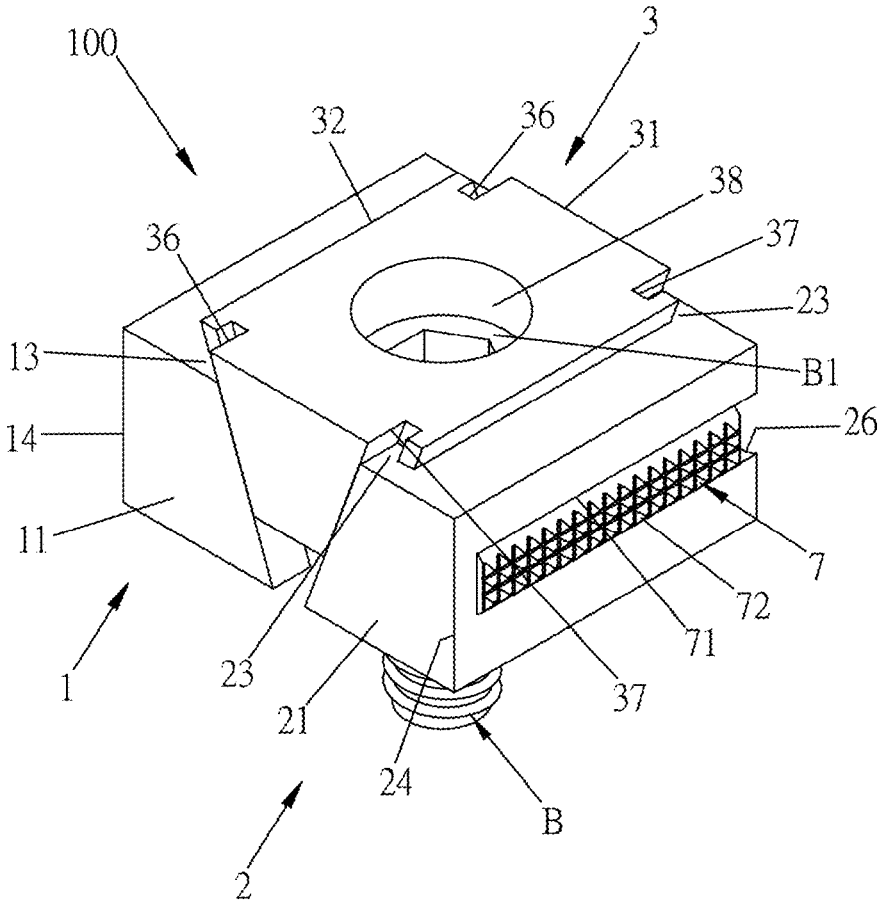
FIG. 2 is a perspective view of the first embodiment of the workpiece clamp device capable for changing clamp angle of the present invention.
Figure 3:
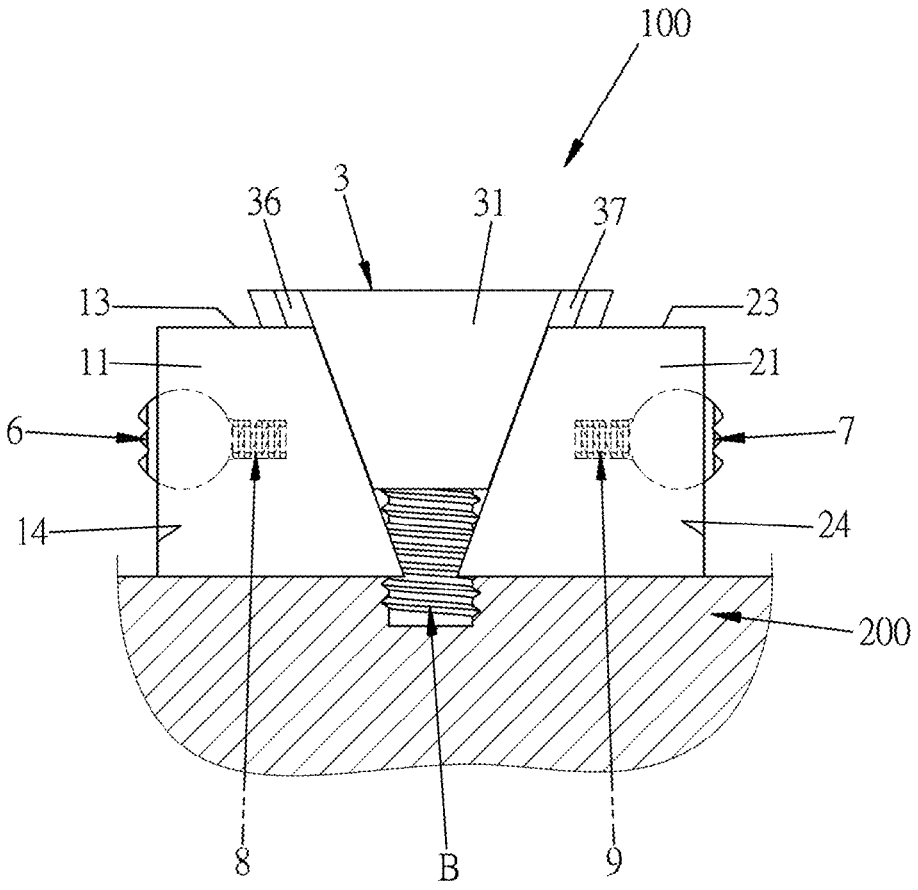
FIG. 3 is a side view of FIG. 2.
Figure 4:
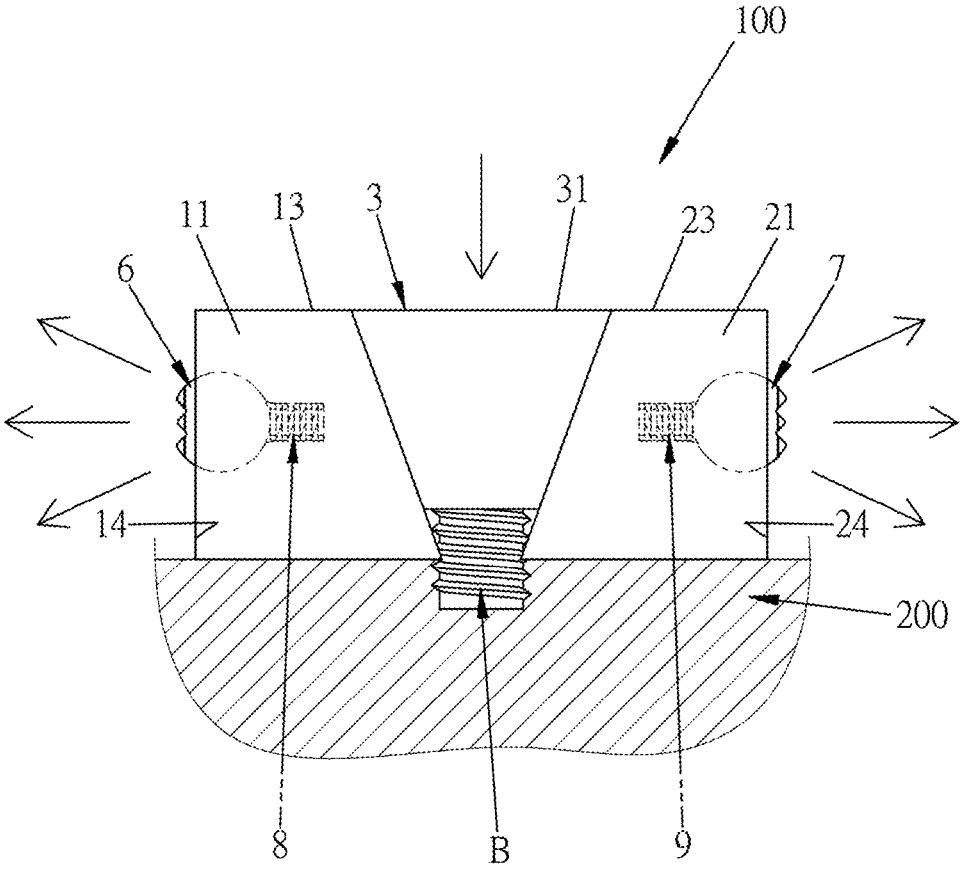
FIG. 4 is a side view of FIG. 2 while being adjusted.

Referring now to the drawings where like characteristics and features among the various figures are denoted by like reference characters.

Please refer to FIGS. 1 to 4, the workpiece clamp device 100 capable for changing clamp angle of the present invention may be arranged on a base plane 200 and comprise a first movable block 1, a second movable block 2, a driving block 3, at least one first elastic member 4, at least one second elastic member 5, at least one first cylinder 6, at least one second cylinder 7, at least one third elastic member 8, and at least one fourth elastic member 9.

The first movable block 1 may have a first main body 11, a first inclined surface 12, a first limit portion 13, and a first clamp surface 14. The first inclined surface 12 is arranged at an inner side of the first main body 11. The first inclined surface 12 is inclined from bottom to top and from interior to exterior. The first clamp surface 14 is arranged at an outer side of the first main body 11 and corresponding to the first inclined surface 12. The first limit portion 13 is arranged at each of a front end and a rear end of the first inclined surface 12. The first inclined surface 12 has at least one first stop portion 15 (two first stop portions for illustration, but not limited thereto), at least one first embedding groove 16 is arranged at the first clamp surface 14. A first receiving groove 17 is further concavely arranged inside the at least one first embedding groove 16. An axial direction of the at least one first embedding groove 16 is orthogonal to an axial direction of the first receiving groove 17.

The second movable block 2 may be arranged corresponding to the first movable block 1 and have a second main body 21, a second inclined surface 22, a second limit portion 23, and a second clamp surface 24. The second inclined surface 22 is arranged at an inner side of the second main body 21. The second inclined surface 22 is inclined from bottom to top and from interior to exterior. The second clamp surface 24 is arranged at an outer side of the second main body 21 and corresponding to the second inclined surface 22. The second limit portion 23 is arranged at each of a front end and a rear end of the second inclined surface 22. The second inclined surface 22 has at least one second stop portion 25 (two second stop portions for illustration, but not limited thereto). At least one second embedding groove 26 is arranged at the second clamp surface 24. A second receiving groove 27 is further concavely arranged inside the at least one second embedding groove 26. An axial direction of the at least one second embedding groove 26 is orthogonal to an axial direction of the second receiving groove 27. The first inclined surface 12 is faced to the second inclined surface 22 and an inverted cone receiving space is defined between the first inclined surface 12 and the second inclined surface 22.

The driving block 3 may be arranged between the first movable block 1 and the second movable block 2 and arranged in the receiving space so as to move up and down. The driving block 3 has a third main body 31, a third inclined surface 32, a fourth inclined surface 33, at least one third stop portion 34, at least one fourth stop portion 35, a third limit portion 36, and a fourth limit portion 37. The third inclined surface 32 and the fourth inclined surface 33 are respectively arranged at two sides of the third main body 31. The third inclined surface 32 is faced to the first inclined surface 12 and inclined from bottom to top and from interior to exterior. The fourth inclined surface 33 is faced to the second inclined surface 22 and inclined from bottom to top and from interior to exterior. The at least one third stop portion 34 (two third stop portions for illustration, but not limited thereto) is arranged on the third inclined surface 32 and corresponding to the at least one first stop portion 15. The at least one fourth stop portion 35 (two fourth stop portions for illustration, but not limited thereto) is arranged on the fourth inclined surface 33 and corresponding to the at least one second stop portion 25. The third limit portion 36 is arranged at each of a front edge and a rear edge of the third inclined surface 32 and corresponding to the first limit portion 13 to cooperate with each other so as to slidably limit. The fourth limit portion 37 is arranged at each of a front edge and a rear edge of the fourth inclined surface 33 and corresponding to the second limit portion 23 to cooperate with each other so as to slidably limit.

The at least one first elastic member 4 (two first elastic members for illustration, but not limited thereto) may be arranged between the at least one first stop portion 15 and the at least one third stop portion 34. Two ends of each first elastic member 4 are respectively abutted against the at least one first stop portion 15 and the at least one third stop portion 34.

The at least one second elastic member 5 (two second elastic members for illustration, but not limited thereto) may be arranged between the at least one second stop portion 25 and the at least one fourth stop portion 35. Two ends of each second elastic member 5 are respectively abutted against the at least one second stop portion 25 and the at least one fourth stop portion 35.

The at least one first cylinder 6 may be slightly rotatably and detachably arranged in the at least one first embedding groove 16. The at least one first cylinder 6 has a first cylindrical body 61 and a first rough surface 62. The first rough surface 62 is arranged at one side of the first cylindrical body 61 along a length direction thereof. The first cylindrical body 61 is received in the at least one first embedding groove 16. And the first rough surface 62 is exposed outside of the at least one first embedding groove 16.

The at least one second cylinder 7 may be slightly rotatably and detachably arranged in the at least one second embedding groove 26. The at least one second cylinder 7 has a second cylindrical body 71 and a second rough surface 72. The second rough surface 72 is arranged at one side of the second cylindrical body 71 along a length direction thereof. The second cylindrical body 71 is received in the at least one second embedding groove 26. And the second rough surface 72 is exposed outside of the at least one second embedding groove 26.

Preferably, the first embedding groove 16 has an open end and the second embedding groove 26 has an open end so that the first cylinder 6 may be detachably arranged in the corresponding first embedding groove 16 and the second cylinder 7 may be detachably arranged in the corresponding second embedding groove 26.

The at least one third elastic member 8 may be received in the at least one first receiving groove 17. Two ends of the third elastic member 8 are respectively abutted against the corresponding first receiving groove 17 and one side of the corresponding first cylinder 6 opposite to the first rough surface 62.

The at least one fourth elastic member 9 may be received in the at least one second receiving groove 27. Two ends of the fourth elastic member 9 are respectively abutted against the corresponding second receiving groove 27 and one side of the corresponding second cylinder 7 opposite to the second rough surface 72.

The first stop portion 15, the second stop portion 25, the third stop portion 34, and the fourth stop portion 35 are a vertical blind hole for each. That is, the first stop portion 15 and the second stop portion 25 are the upward vertical blind hole for each, and the third stop portion 34 and the fourth stop portion 35 are the downward blind hole for each.

Preferably, the first limit portion 13 and the second limit portion 23 are a sliding groove for each, and the third limit portion 36 and the fourth limit portion 37 are a sliding track for each. The first limit portion 13 such as the sliding groove may be cooperated with (or embedded with) the third limit portion 36 such as the sliding track so as to slidably limit.

The second limit portion 23 such as the sliding groove may be cooperated with (or embedded with) the fourth limit portion 37 such as the sliding track so as to slidably limit.

Preferably, the first rough surface 62 and the second rough surface 72 may have a plurality of square pyramids.

Please refer to FIGS. 1 to 4, the at least one first embedding groove 16 of the first embodiment is a single one first embedding groove and the at least one second embedding groove 26 of the first embodiment is a single one second embedding groove. The axial direction of the first embedding groove 16 is parallel to a length direction of the first movable block 1 and the axial direction of the second embedding groove 26 is parallel to a length direction of the second movable block 2.

Figure 5:
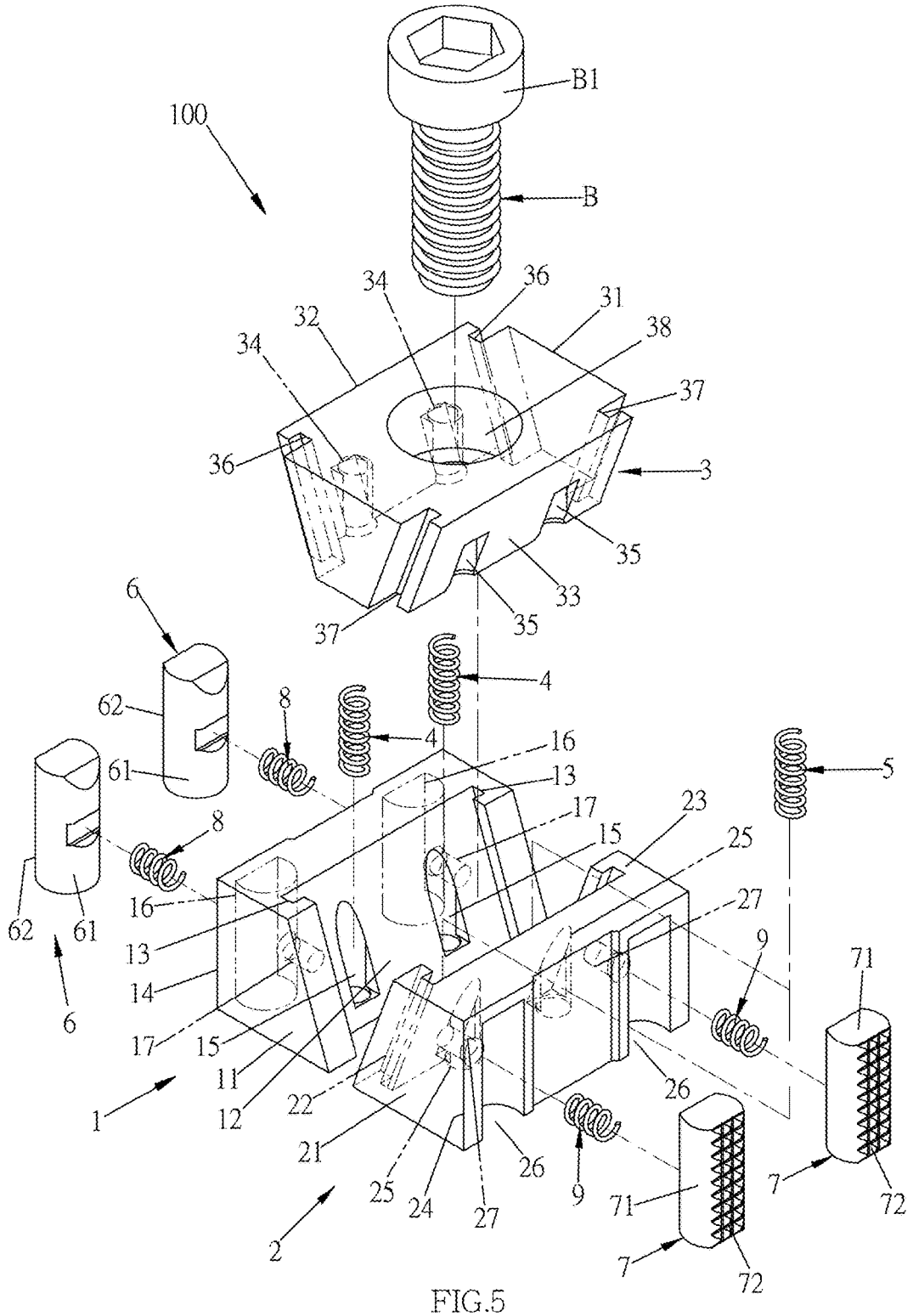
FIG. 5 is an exploded view of a second embodiment of workpiece clamp device capable for changing clamp angle of the present invention.
Figure 6:
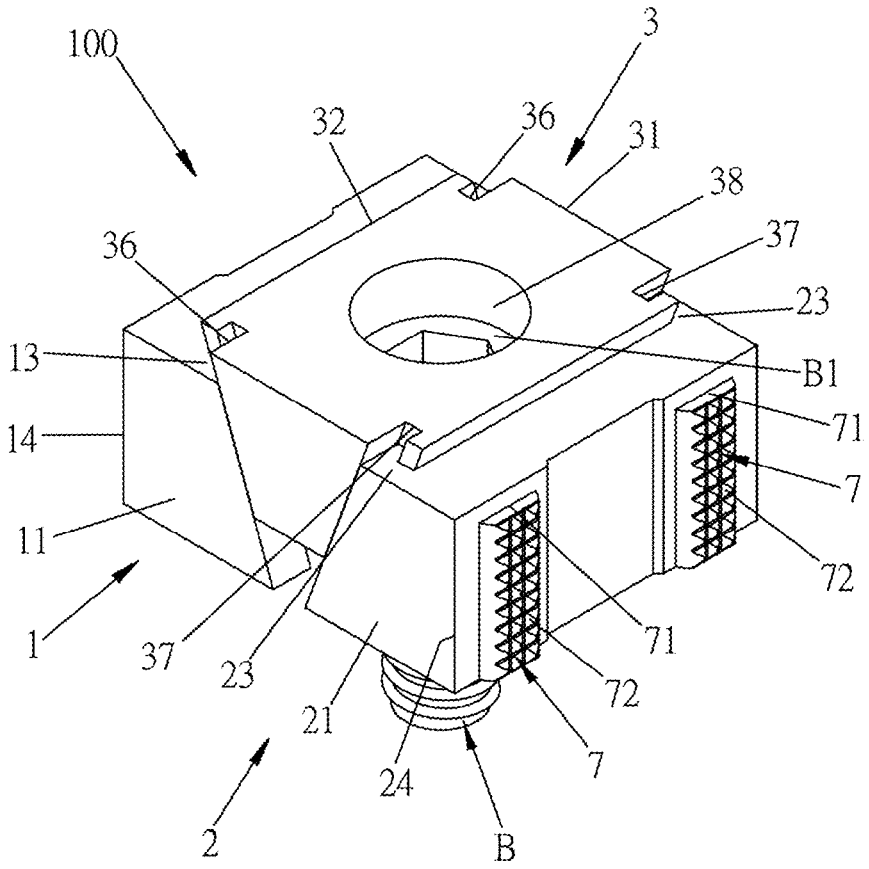
FIG. 6 is a perspective view of the second embodiment of the workpiece clamp device capable for changing clamp angle of the present invention.
Figure 7:
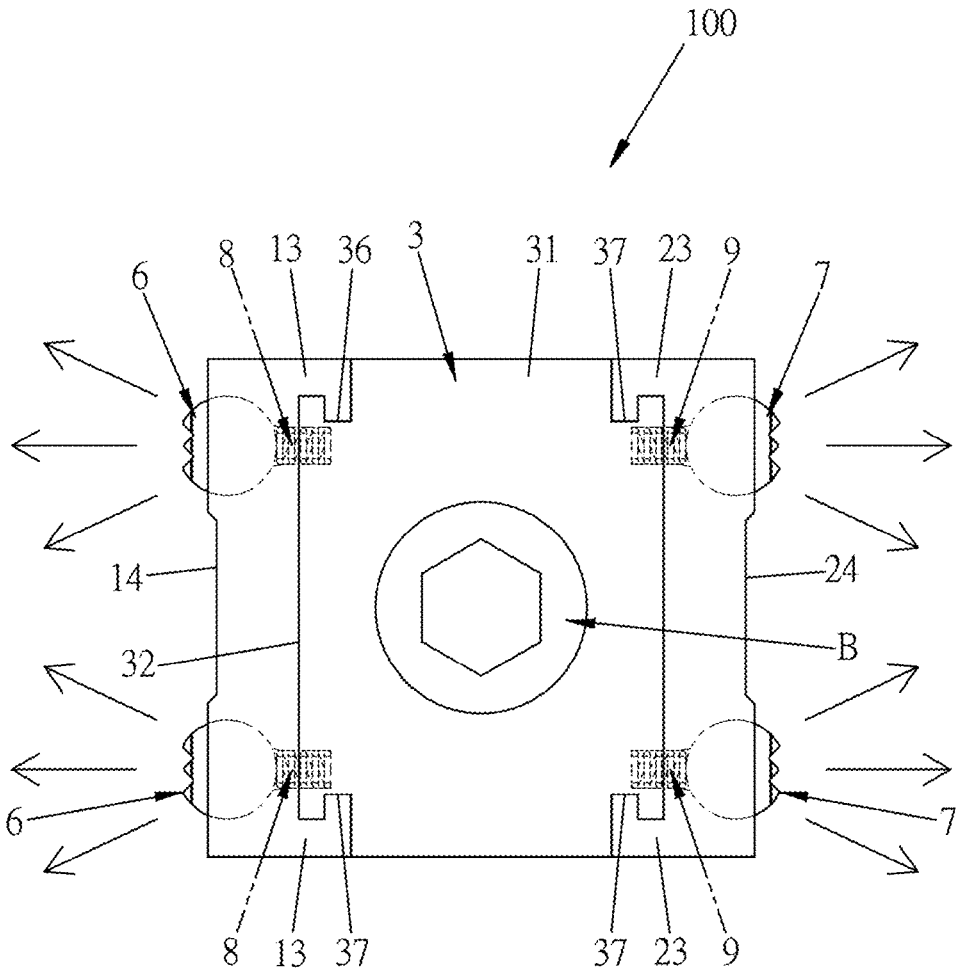
FIG. 7 is a top view of FIG. 6.
Figure 8:
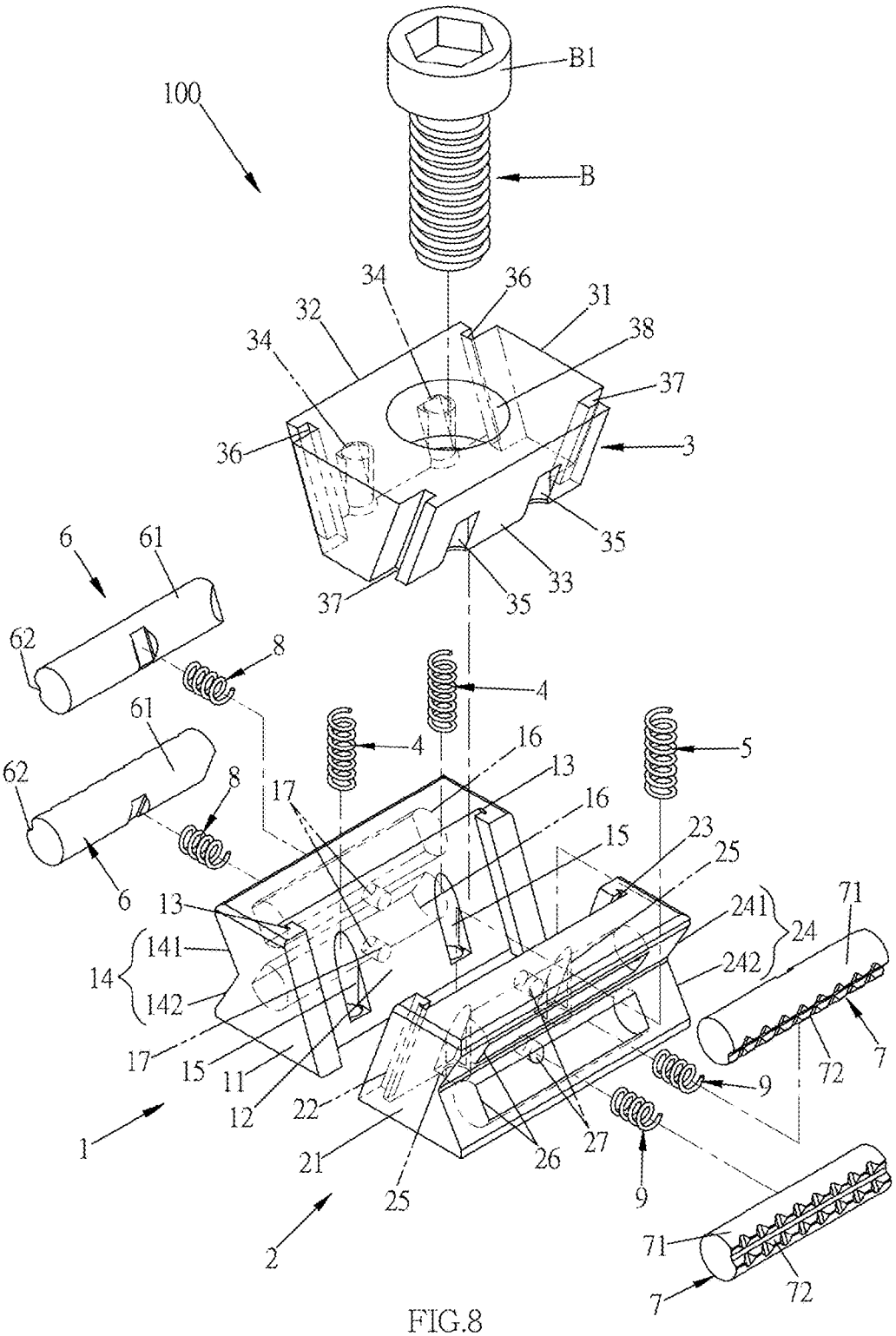
FIG. 8 is an exploded view of a third embodiment of the workpiece clamp device capable for changing clamp angle of the present invention.
Figure 9:
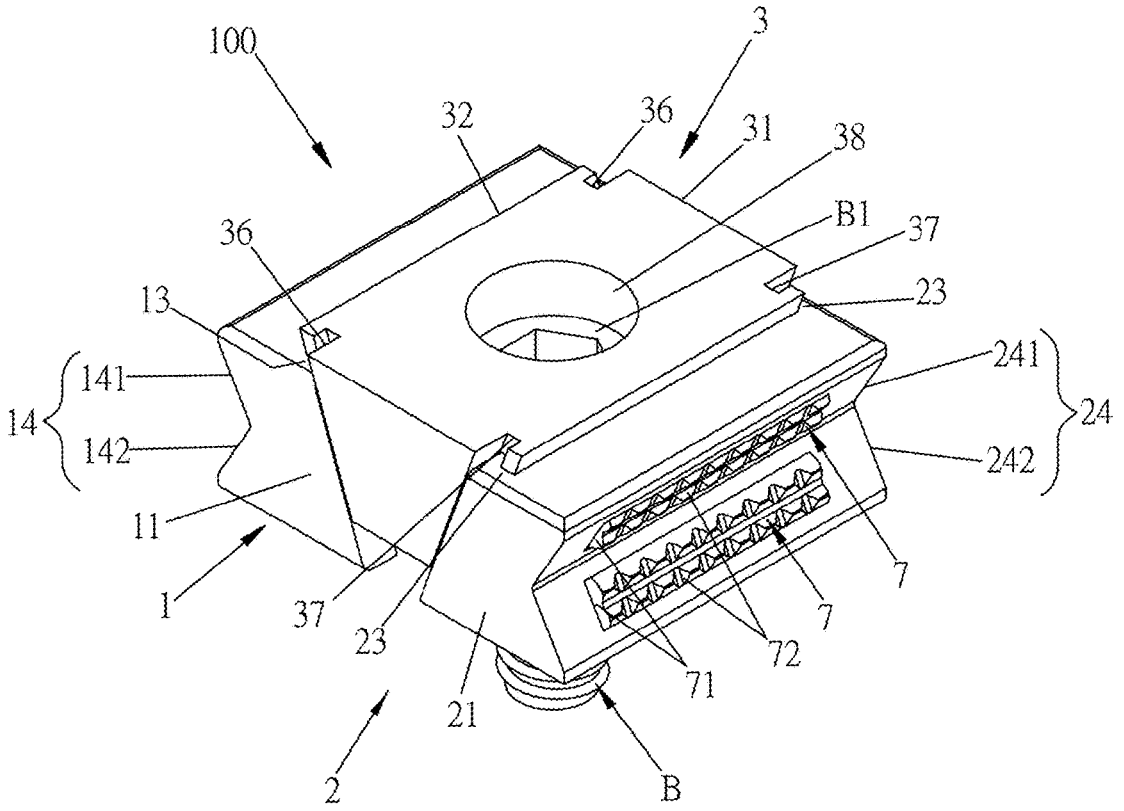
FIG. 9 is a perspective view of the third embodiment of the workpiece clamp device capable for changing clamp angle of the present invention.
Figure 10:
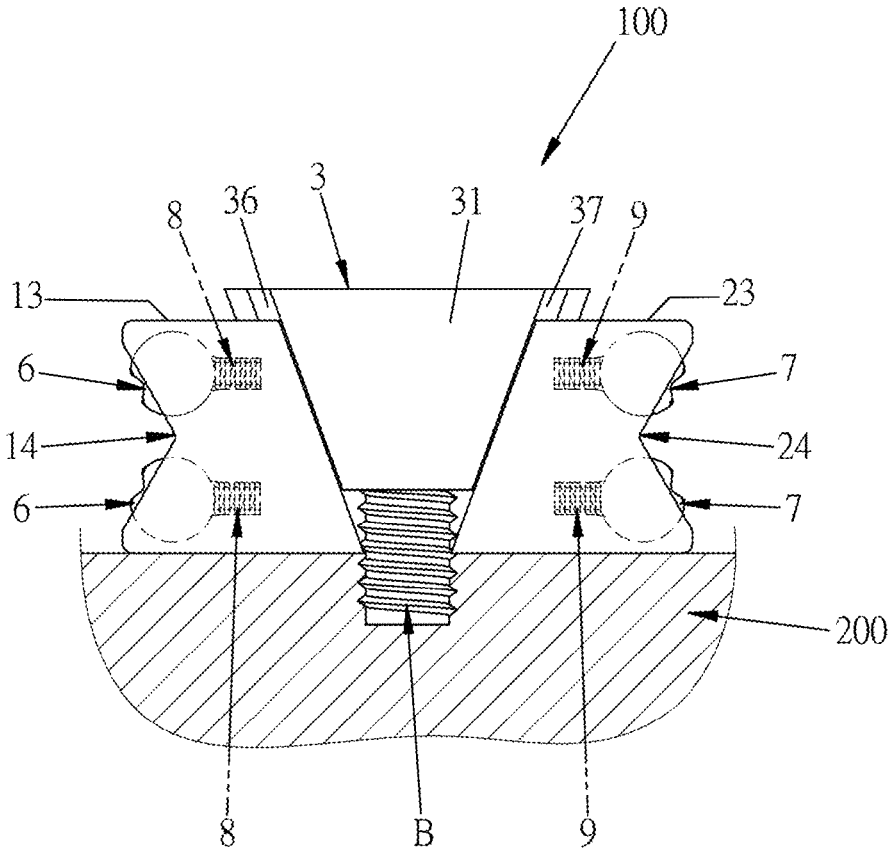
FIG. 10 is a side view of FIG. 9.
Figure 11:
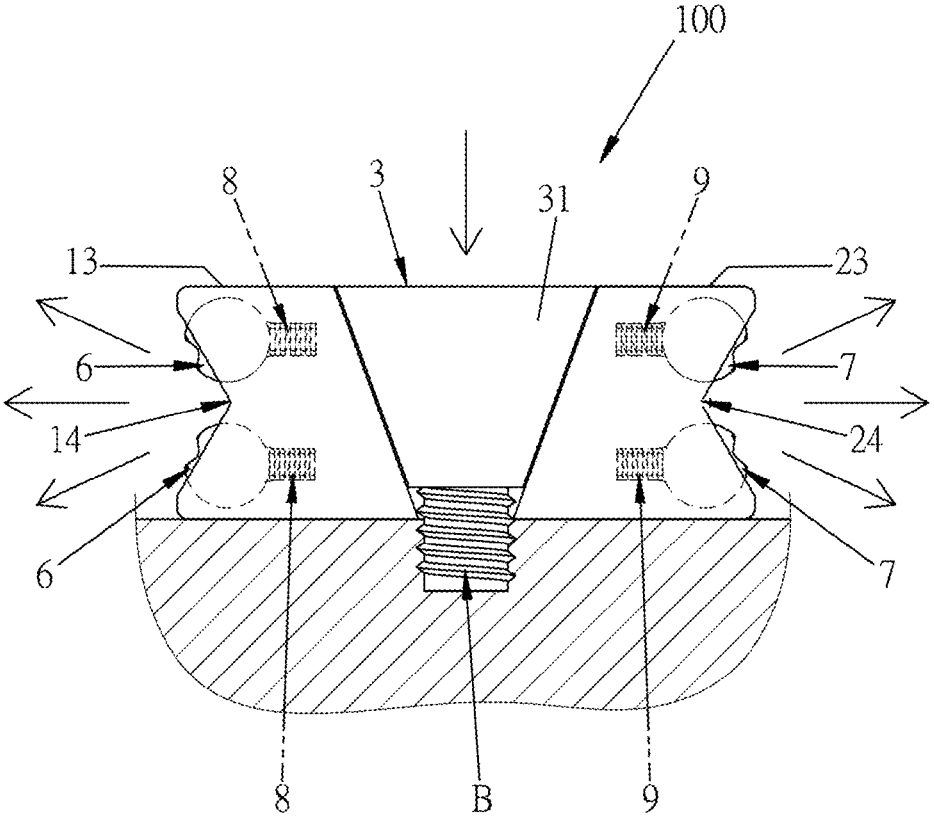
FIG. 11 is an operational view of FIG. 9.

Please refer to FIGS. 5 to 7, the at least one first embedding groove of the second embodiment is two first embedding grooves which are spaced apart from each other. The at least one second embedding groove 26 of the second embodiment is two second embedding grooves which are spaced apart from each other. The axial direction of each first embedding groove 16 is parallel to a height direction of the first movable block 1 and the axial direction of each second embedding groove 26 is parallel to a height direction of the second movable block 2. That is, each first embedding groove 16 and each second embedding groove 26 are arranged vertically.

Please refer to FIGS. 8 to 11, in the third embodiment, a longitudinal section of each of the first clamp surface 14 and the second clamp surface 24 is concave V-shaped (that is, a transverse V-shaped concave). The first clamp surface 14 has a first upper half portion 141 and a first lower half portion 142. The second clamp surface 24 has a second upper portion 241 and a second lower portion 242. The at least one first embedding groove 16 is two first embedding grooves 16 which are respectively concavely arranged at the first upper half portion 141 and the first lower half portion 142. The at least one second embedding groove 26 is two second embedding grooves which are respectively concavely arranged at the second upper half portion 241 and the lower half portion 242. The axial direction of each first embedding groove 16 is parallel to a length direction of the first movable block 1 and the axial direction of each second embedding groove 26 is parallel to a length direction of the second movable block 2.

Since the first cylinder 6 is slightly rotatably and detachably embedded in the corresponding first embedding groove 6 to make the first rough surface 62 be exposed, the second cylinder 7 is slightly rotatably and detachably embedded in the corresponding second embedding groove 26 to make the second rough surface 72 be exposed, and the elasticity of the third elastic member 8 and the fourth elastic member 9 is cooperated therewith, the first rough surface 62 and the second rough surface 72 may be slightly rotated to fine tune based on the shapes and sizes of the various workpieces (not shown) waiting for processing so as to be suitable for clamping and fastening the workpieces with different shapes and further prevent the workpiece waiting for processing from being defect due to instability and deflection while processing.

Besides, the third main body 31 of the driving block 3 has a vertical step hole 38. A bolt B (the number thereof may be equal to the one of the vertical step hole) is passing through the corresponding vertical step hole 38 and then screwed with the base plane 200 so that a head portion B1 of the bolt B is abutted against the vertical step hole 38. The first inclined surface 12 is pushed by the third inclined surface 32 and the second inclined surface 22 is pushed by the fourth inclined surface 33 so as to make the first movable block 1 and the second movable block 2 move outward and inward to achieve the effect of clamping because the bolt B is screwed in and screwed out relative to the base plane 200 and simultaneously cooperated with the elasticity of the first elastic member 4 and the second elastic member 5.

In detail, when the bolt B is screwed in relative to the base plane 200, the head portion B1 of the bolt B is pressed against the vertical step hole 38 of the third main body 31 of the driving block 3 to make the driving block 3 move downward (move toward the base plane 200) and further the first inclined surface 12 is pushed by the third inclined surface 32 and the second inclined surface 22 is pushed by the fourth inclined surface 33. At the same time, the first limit portion 13 such as the sliding groove is cooperated or embedded with the third limit portion 36 such as sliding track to slidably limit. The second limit portion 23 such as the sliding groove is cooperated or embedded with the fourth limit portion 37 such as the sliding track to slidably limit. Therefore, the first movable block 1 and the second movable block 2 are moved outward (move to the direction opposite to the driving block 3). At this time, two ends of the first elastic member 4 is respectively abutted against the first stop portion 15 and the third stop portion 34 to be compressed and two ends of the second elastic member 5 are respectively abutted against the second stop portion 25 and the fourth stop portion 35 to be compressed.

Furthermore, when the bolt B is screwed out relative to the base plane 200, the head portion B1 of the bolt B is released from the vertical step hole 38 of the third main body 31 of the driving block 3. Two ends of the first elastic member 4 are reset to respectively push the first stop portion 15 and the third stop portion 34. Two ends of the second elastic member 5 are reset to respectively push the second stop portion 25 and the fourth stop portion 35. Therefore, the driving block 3 is moved upward (move to the direction opposite to the base plane 200). The first inclined surface 12 is released by the third inclined surface 32 and the second inclined surface 22 is released by the fourth inclined surface 22. At the same time, the first limit portion 13 such as the sliding groove is cooperated or embedded with the third limit portion 36 such as sliding track to slidably limit. The second limit portion 23 such as the sliding groove is cooperated or embedded with the fourth limit portion 37 such as the sliding track to slidably limit. Therefore, the first movable block 1 and the second movable block 2 are moved inward (move toward the driving block 3).

When operating, lots of the workpiece clamp devices 100 of the present invention is arranged on the base plane 200 and spaced apart from one another. Each workpiece (not shown) may be arranged between two adjacent workpiece clamp devices 100. When the bolt B is screwed in the base plane 200, the first movable block 1 and the second movable block 2 of each workpiece clamp device 100 are moved outward (move to the direction opposite to the driving block 3) to clamp the workpiece therebetween to achieve the effect of clamping. That is, the first movable block 1 of one of the two adjacent workpiece clamp devices 100 and the second movable block 2 of the other one thereof are arranged corresponding to each other and moved to each other.

The foregoing descriptions are merely the exemplified embodiments of the present invention, where the scope of the claim of the present invention is not intended to be limited by the embodiments. Any equivalent embodiments or modifications without departing from the spirit and scope of the present invention are therefore intended to be embraced.

The disclosed structure of the invention has not appeared in the prior art and features efficacy better than the prior structure which is construed to be a novel and creative invention, thereby filing the present application herein subject to the patent law.

What is claimed is:

1. A workpiece clamp device capable of changing a clamp angle and arranged on a base plane, the device comprising:

a first movable block, having a first main body, a first inclined surface, a first limit portion, and a first clamp surface, the first inclined surface is arranged at an inner side of the first main body and inclined from a bottom to a top and from an interior to an exterior, the first clamp surface is arranged at an outer side of the first main body, corresponding to the first inclined surface, the first limit portion is arranged at each of a front end and a rear end of the first main body, the first inclined surface has at least one first stop portion, at least one first embedding groove is arranged at the first clamp surface, a first receiving groove is further concavely arranged inside the at least one first embedding groove, an axial direction of the at least one first embedding groove is orthogonal to an axial direction of the first receiving groove;

a second movable block, arranged corresponding to the first movable block and having a second main body, a second inclined surface, a second limit portion, and a second clamp surface, the second inclined surface is arranged at an inner side of the second main body and inclined from a bottom to a top and from an interior to an exterior, the second clamp surface is arranged at an outer side of the second main body and corresponding to the second inclined surface, the second limit portion is arranged at each of a front end and a rear end of the second inclined surface, the second inclined surface has at least one second stop portion, at least one second embedding groove is arranged at the second clamp surface, a second receiving groove is further concavely arranged inside the at least one second embedding groove, an axial direction of the at least one second embedding groove is orthogonal to an axial direction of the second receiving groove, the first inclined surface is faced to the second inclined surface and an inverted cone receiving space is defined between the first inclined surface and the second inclined surface;

a driving block is arranged between the first movable block and the second movable block and in the receiving space so as to move up and down, and having a third main body, a third inclined surface, a fourth inclined surface, at least one third stop portion, at least one fourth stop portion, a third limit portion, and a fourth limit portion, the third inclined surface and the fourth inclined surface are respectively arranged at two opposed sides of the third main body, the third inclined surface is faced to the first inclined surface and inclined from a bottom to a top and from an interior to an exterior, the fourth inclined surface is faced to the second inclined surface and inclined from the bottom to the top and from the interior to the exterior, the at least one third stop portion is arranged on the third inclined surface and corresponding to the at least one first stop portion, the at least one fourth stop portion is arranged on the fourth inclined surface and corresponding to the at least one second stop portion, the third limit portion is arranged at each of a front edge and a rear edge of the third inclined surface and corresponding to the first limit portion to cooperate with each other so as to slidably limit, the fourth limit portion is arranged at each of a front edge and a rear edge of the fourth inclined surface and corresponding to the second limit portion to cooperate with each other so as to slidably limit;

at least one first elastic member, arranged between the at least one first stop portion and the at least one third stop portion, two ends of the at least one first elastic member are respectively abutted against the at least one first stop portion and the at least one third stop portion;

at least one second elastic member, arranged between the at least one second stop portion and the at least one fourth stop portion, two ends of the at least one second elastic member are respectively abutted against the at least one second stop portion and the at least one fourth stop portion;

at least one first cylinder, rotatably and detachably arranged in the at least one first embedding groove and having a first cylindrical body and a first rough surface arranged at one side of the first cylindrical body along a length direction thereof and exposed outside of the at least one first embedding groove;

at least one second cylinder, rotatably and detachably arranged in the at least one second embedding groove and having a second cylindrical body and a second rough surface arranged at one side of the second cylindrical body along a length direction thereof and exposed outside of the at least one second embedding groove;

at least one third elastic member, received in the at least one first receiving groove, two ends of the at least one third elastic member are respectively abutted against the first receiving groove and one side of the at least one first cylinder opposite to the first rough surface; and at least one fourth elastic member, received in the at least one second receiving groove, two ends of the at least one fourth elastic member are respectively abutted against the second receiving groove and one side of the at least one second cylinder opposite to the second rough surface.

2. The workpiece clamp device as claimed in claim 1, wherein the at least one first, second, third, and fourth stop portions are each a vertical blind hole.

3. The workpiece clamp device as claimed in claim 1, wherein the first and the second limit portions are each a sliding groove, the third and the fourth limit portions are each a sliding track, the first limit portion and the third limit portion are cooperated with each other so as to slidably limit, and the second limit portion and the fourth limit portion are cooperated with each other so as to slidably limit.

4. The workpiece clamp device as claimed in claim 1, wherein the first rough surface and the second rough surface are arranged as a plurality of square pyramids.

5. The workpiece clamp device as claimed in claim 1, wherein the third main body of the driving block has a vertical step hole, a bolt passes through the vertical step hole of the driving block so as to screw with the base plane, a head portion of the bolt is abutted against the vertical step hole, the driving block is controlled to move up and down as the bolt is screwed in and screwed out relative to the base plane and simultaneously cooperated with elasticity of the at least one first and second elastic members, and the third inclined surface engages the first inclined surface and the fourth inclined surface engages the second inclined surface so that the first movable block and the second movable block are moved inward and outward.

6. The workpiece clamp device as claimed in claim 1, wherein the at least one first embedding groove is a single one first embedding groove, the at least one second embedding groove is a single one second embedding groove, the axial direction of the first embedding groove is parallel to a length direction of the first movable block, and the axial direction of the second embedding groove is parallel to a length direction of the second movable block.

7. The workpiece clamp device as claimed in claim 1, wherein the at least one first embedding groove is two first embedding grooves which are spaced apart from each other, the at least one second embedding groove is two second embedding grooves which are spaced apart from each other, the axial direction of each first embedding groove is parallel to a height direction of the first movable block, and the axial direction of each second embedding groove is parallel to a height direction of the second movable block.

8. The workpiece clamp device as claimed in claim 1, wherein a longitudinal section of each of the first clamp surface and the second clamp surface is concave V-shaped, the first clamp surface has a first upper half portion and a first lower half portion, the second clamp surface has a second upper half portion and a second lower half portion, the at least one first embedding groove is two first embedding grooves which are respectively concavely arranged at the first upper half portion and the first lower half portion, the at least one second embedding groove is two second embedding grooves which are respectively concavely arranged at the second upper half portion and the second lower half portion, the axial direction of each first embedding groove is parallel to a length direction of the first movable block, and the axial direction of each second embedding groove is parallel to a length direction of the second movable block.

* * * * *